United States Patent [19]

Broghammer et al.

[11] 4,276,625

[45] Jun. 30, 1981

[54] BELL-STRIKING CLOCK

[75] Inventors: Rudolf Broghammer, Eschbronn-Mariazell; Franz Käser, Schwarzwald, both of Fed. Rep. of Germany

[73] Assignee: Kundo - Kieninger + Obergfell, Schwarzwald, Fed. Rep. of Germany

[21] Appl. No.: 128,518

[22] Filed: Mar. 10, 1980

Related U.S. Application Data

[63] Continuation-in-part of Ser. No. 29,758, Apr. 12, 1979, abandoned.

[30] Foreign Application Priority Data

Apr. 22, 1978 [DE] Fed. Rep. of Germany ..... 2817762

[51] Int. Cl.[3] ..... G04C 21/06

[52] U.S. Cl. ..... 368/75; 368/243; 340/384 E; 340/392

[58] Field of Search ..... 340/384 E, 384 R, 392; 368/75, 243

[56] References Cited

U.S. PATENT DOCUMENTS

| | | | |
|---|---|---|---|
| 2,791,146 | 5/1957 | Kunz | 340/392 X |
| 2,988,708 | 6/1961 | Schmidt | 340/392 X |
| 3,577,725 | 5/1971 | Ganter et al. | 340/292 X |
| 3,689,919 | 9/1972 | Ganter et al. | 340/392 |

*Primary Examiner*—Edith S. Jackmon
*Attorney, Agent, or Firm*—Karl F. Ross

[57] ABSTRACT

An electronic clock emitting half-hourly time signals corresponding to the strokes of ships' bells comprises an electromagnetic striker driven by a normally blocked astable multivibrator whenever the closure of contacts operated by an associated clockwork, stepped by a crystal-controlled square-wave generator, coincides with a half-circle of predetermined polarity of the generated square wave. The multivibrator has a period of approximately ¾ the duration of a half-circle of the square wave whereby not more than two pulses energizing the striker mechanism can be emitted by it during an unblocking half-circle so that strokes occurring at the ends of a second, third and fourth hour of a four-hour watch will appear in distinct pairs while those on the preceding half-hours will form one or more pairs followed by a single stroke after a larger time interval. The total number of strokes produced in each instance is determined by a comparator receiving the output of an electronic counter, advanced by the multivibrator pulses, together with binary signals generated by a multibank rotary switch entrained by the clockwork.

10 Claims, 5 Drawing Figures

BELL-STRIKING CLOCK

CROSS-REFERENCE TO RELATED APPLICATION

This is a continuation-in-part of our copending application Ser. No. 29,758 filed Apr. 12, 1979 and now abandoned.

FIELD OF THE INVENTION

Our present invention relates to an electronic clock emitting time signals which correspond to the strokes of ships' bells.

BACKGROUND OF THE INVENTION

As is known, ships' bells are sounded on both the half and the full hour with a pattern of strokes recurring after a 4-hour operating period or "watch". The number of strokes is odd on the half hour and even (i.e. one, two, three or four stroke pairs) on the full hour. The separation of the stroke pairs on the 2nd, 3rd and 4th hour is greater than the interval between the strokes of any pair; on the preceding half hour, similarly, the stroke pair or pairs are followed after a larger interval by a single stroke.

In earlier times, clocks of this type were widely used aboard naval vessels and merchant ships for the purpose of giving chronometric information by acoustic signaling to the seamen on duty. The half-hour timing stems from the original use of 30-minute sandglasses for this purpose. With the 24-hour day divided into six 4-hour watches, the number of bells generally conforms to the following program:

| | | |
|---|---|---|
| Midnight | (noon) | : 8 bells (beginning of watch) |
| 0030 hours | (1230 hours) | : 1 bell |
| 0100 hours | (1300 hours) | : 2 bells |
| 0200 hours | (1400 hours) | : 4 bells |
| 0230 hours | (1430 hours) | : 5 bells |
| 0300 hours | (1500 hours) | : 6 bells |
| 0330 hours | (1530 hours) | : 7 bells |
| 0400 hours | (1600 hours) | : 8 bells (change of watch) |
| 0430 hours | (1630 hours) | : 1 bell (beginning of new watch) |
| and so forth. | | |

Although so-called ships' clocks are no longer in common use aboard naval and commercial vessels, they are popular as timepieces on pleasure boats and even in dwellings.

A variety of electronic circuits have already been proposed for the operation of a striker mechanism in response to periodic switch closures by an associated clockwork. See, for example, U.S. Pat. Nos. 3,689,919 and 3,210,913, the latter referring particularly to a ship's clock.

OBJECTS OF THE INVENTION

The general object of our present invention is to provide a simple, inexpensive and reliable electronic control system for a clock of the character described above.

A more particular object is to provide a system of this type in combination with an electromagnetic striker mechanism operating with low current consumption so as to be usable for prolonged periods even with battery-operated clocks.

SUMMARY OF THE INVENTION

In accordance with our present invention, an electronic clock as defined above comprises a clockwork which includes a generator of a square wave with interleaved first and second half-cycles of different voltage levels, normally blocked pulse-producing means with a recurrence period equal to less than one half-cycle but not less than one quarter-cycle of the square wave, a striker mechanism connected to an output of the pulse-producing means for sounding a stroke in response to each emitted pulse, normally open switch means briefly closed by the clockwork every 30 minutes for activating a switching circuit into emission of an unblocking signal to the pulse-producing means, the square-wave generator having an enabling circuit connected to the pulse-producing means for making the unblocking signal effective only during the first half-cycles of the square wave whereby not more than two consecutive pulses can be emitted to the striker mechanism during any wave cycle, and control means for deactivating the switching circuit after the emission of a number of pulses rising from one through eight in successive half-hour intervals of a four-hour operating period.

The pulse-producing means advantageously comprises an astable multivibrator with two cascaded complementary transistors generating short pulses with a width of less than one-tenth of a second and with a recurrence period of substantially three-quarters of a second when the square wave has half-cycles lasting for one second; such a cycle length is convenient for the stepping of the hands of the clockwork.

BRIEF DESCRIPTION OF THE DRAWING

The above and other features of our invention will now be described in detail with reference to the accompanying drawing in which.

SPECIFIC DESCRIPTION

Figure 1:
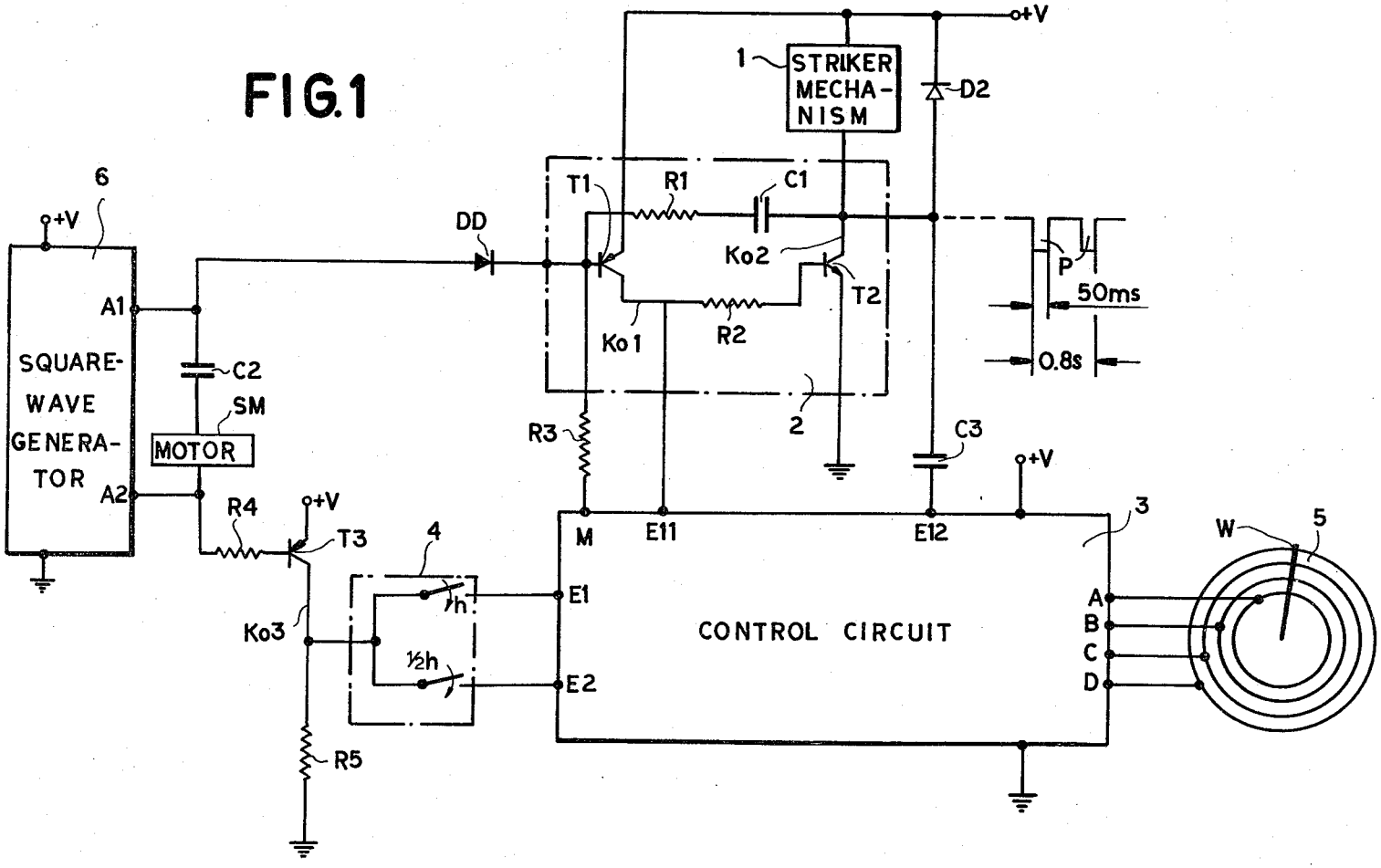
FIG. 1 is a block diagram of a sound-generating system for a ship's clock according to the invention.

FIG. 1 shows a striker mechanism 1, advantageously an electromagnetic one as described hereinafter with reference to FIGS. 4 an 5, responsive to short voltage pulses P emitted from time to time by a pulse generator 2 here shown as an astable multivibrator comprising two cascaded complementary transistors T1 (PNP) and T2 (NPN), input transistor T1 having its base connected to the collector lead Ko2 of output transistor T2 via a feedback path including a capacitor C1 and a resistor R1 in series. Another resistor R2 extends between the collector lead Ko1 of transistor T1 and the base of transistor T2. Such an astable multivibrator draws very little current and operates reliably even in the face of a diminishing supply voltage from a d-c source, e.g. a battery, whose positive terminal has been designated +V and whose negative terminal is grounded. Supply terminal +V is connected directly to the emitter of transistor T1 and by way of striker mechanism 1 to the collector of transistor T2 whose emitter is grounded.

The two collector leads Ko1, Ko2 are further connected to respective input terminals E11 and E12 of a control circuit 3, with interposition of a capacitor C3 in the case of lead Ko2.

Control circuit 3 has an output terminal M which is connected through a resistor R3 to the base of transistor T1, that base being further connected via a diode DD to an output terminal A1 of a preferably crystal-controlled square-wave generator 6.

Figure 3:
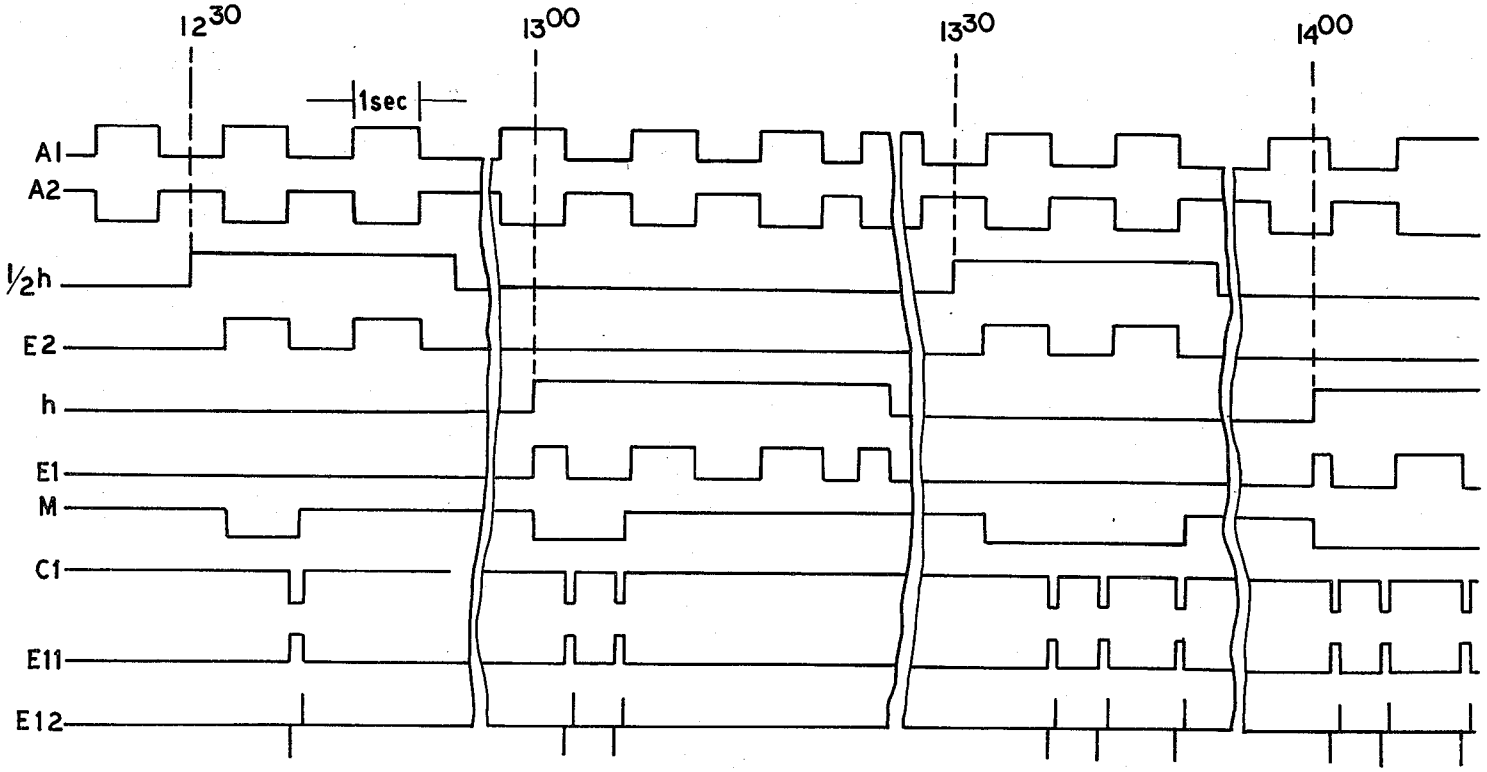
FIG. 3 is a set of graphs relating to the operation of the system of FIGS. 1 and 2.

A stepping motor SM, serving to drive the nonillustrated hands of an associated clockwork, is inserted in series with a capacitor C2 between output terminals A1 and A2 of generator 6 carrying mutually complementary square waves as shown in the corresponding graphs of FIG. 3. The negative half-cycles of these square waves are at zero level and, like the intervening positive half-cycles, have a duration of one second corresponding to a 2-second wave cycle. Such a square wave can be readily generated with the aid of a multistage frequency divider in the output of a crystal-controlled high-frequency oscillator as is well known in the art.

A further PNP transistor T3, with an emitter connected to positive supply +V and a collector grounded via a resistor R5, has its base connected to output terminal A2 by way of a series resistor R4. A mechanical interrupter 4, controlled by the clockwork, comprises a pair of full-hour contacts h and half-hour contacts ½ h which are normally open and are inserted between the collector lead Ko3 of transistor T3 and respective inputs E1, E2 of control circuit 3. This control circuit has also four inputs tied to leads A, B, C, D that are energized in certain combinations, as more fully described hereinafter, by a timer in the form of a multibank rotary switch 5 comprising a wiper W which is driven by the clockwork to sweep four sets of bank contacts during a 4-hour operating period or watch. During that operating period, contacts h and ½ h close for several seconds on the full hour and on the half hour, respectively, as shown in the corresponding graphs of FIG. 3. Transistor T3, acting as an amplifier, decoupler and phase corrector, inverts the square wave appearing on output terminal A2 so that these contacts receive positive voltage concurrently with the appearance of positive potential on output terminal A1 of generator 6.

In the presence of such positive potential, transmitted via diode DD to the base of transistor T1, this transistor is cut off so that multivibrator 2 is blocked. Such cutoff occurs also in the presence of positive voltage on output terminal M of control circuit 3 so that pulses P can be generated only when both terminals A1 and M carry zero voltage. Whenever this occurs, a charging current begins to flow from capacitor C1 through voltage divider R1, R3 to terminal M; almost immediately, transistor T1 conducts and drives transistor T2 into conduction, thereby substantially grounding its collector lead Ko2. At that point, the emitter/base current of transistor T1 begins to charge the capacitor C1 in the opposite sense at a rate determined by the time constant of the feedback path R1/C1. After a short time, here 50 ms as indicated in FIG. 1, the capacitor charge has reached such a value that transistors T1 and T2 are again cut off. If the potential of terminals A1 and M is still zero, a charging current now flows again from capacitor C1 via resistors R1 and R3 to terminal M until the two cascaded transistors become once more conductive. In this specific instance, again as indicated in FIG. 1, the recurrence period is 0.75 sec so that the time between the leading edge of the first pulse P and the trailing edge of the second pulse P measures 0.8 sec, being thus less than the duration of a half-cycle of the square wave appearing on terminal A1. It will therefore be apparent that, even with the unblocking signal (zero voltage) on terminal M maintained for an extended period, not more than two pulses P can be generated during any cycle of that square wave. Capacitor C1 may have, for example, a capacitance of 6.8 μF, with resistor R1 having a resistance of 1.2 KΩ.

Figure 5:
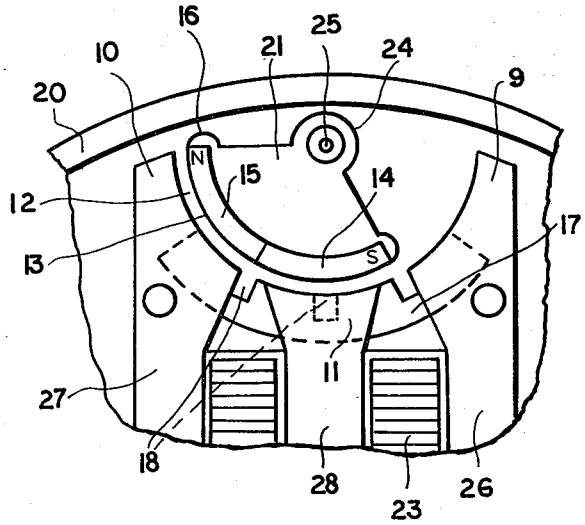
FIG. 5 is an enlarged fragmentary view of the mechanism of FIG. 4 in an alternate position.

Each pulse P emitted by multivibrator 2, being of negative polarity, gives rise to a brief current surge through striker mechanism 1, resulting in the sounding of one stroke. As shown in FIGS. 4 and 5, this striker mechanism advantageously comprises a metallic housing 20 within which an armature 21 is swingable about a pivot pin 25 passing through a hub 24 thereof. A coil 23, traversed by the collector current of transistor T2 (FIG. 1) when the latter is conductive, is wound about the middle leg 28 of a 3-legged core 22 of soft-iron sheet metal also having two outer legs 26 and 27, these three legs terminating in arcuate pole shoes 9, 10 and 11 separated by a narrow gap 12 from a peripheral zone 13 of armature 21 which is permanently magnetized with a south pole S in one half 14 and a north pole N in the other half 15. The three pole shoes are bridged by a ring-segmental strip 17 provided on its inner periphery with recesses 18.

Figure 4:
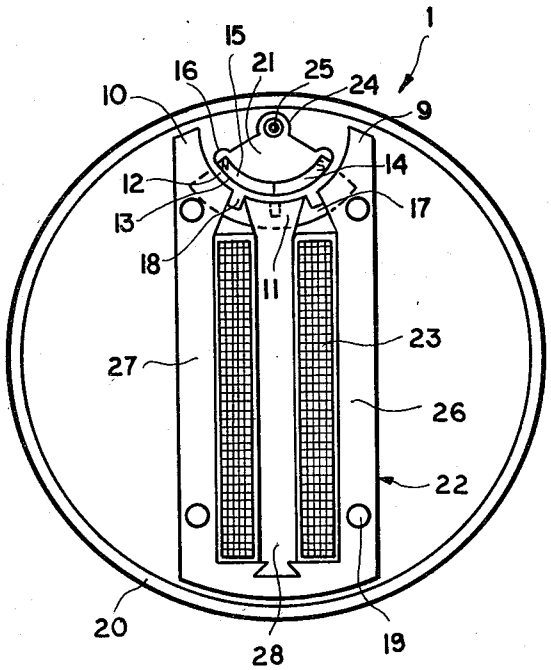
FIG. 4 is a face view of a striker mechanism included in the system of FIG. 1.

When the coil 23 is energized by collector current of transistor T2, pole shoe 11 becomes a north pole whereupon armature 21 is swung out from its normal position of FIG. 4 into the off-normal position of FIG. 5. In its outward swing, however, the armature overshoots that off-normal position whereby a boss 16 thereof strikes the housing 20, designed as an acoustic resonator, to generate a bell stroke. If coil 23 is still energized on the return swing of the armature, the latter is magnetically arrested in the position of FIG. 5; with the brief current surges produced by the spikes P of FIG. 1, however, the armature quickly returns to its normal position in readiness for the next stroke. It should be noted that the magnetic circuit formed by pole shoes 9, 10 and legs 26, 27 of core 22 tends to maintain the armature 21 in that normal position in which these pole shoes respectively confront its south and north poles 14 and 15.

Figure 2:
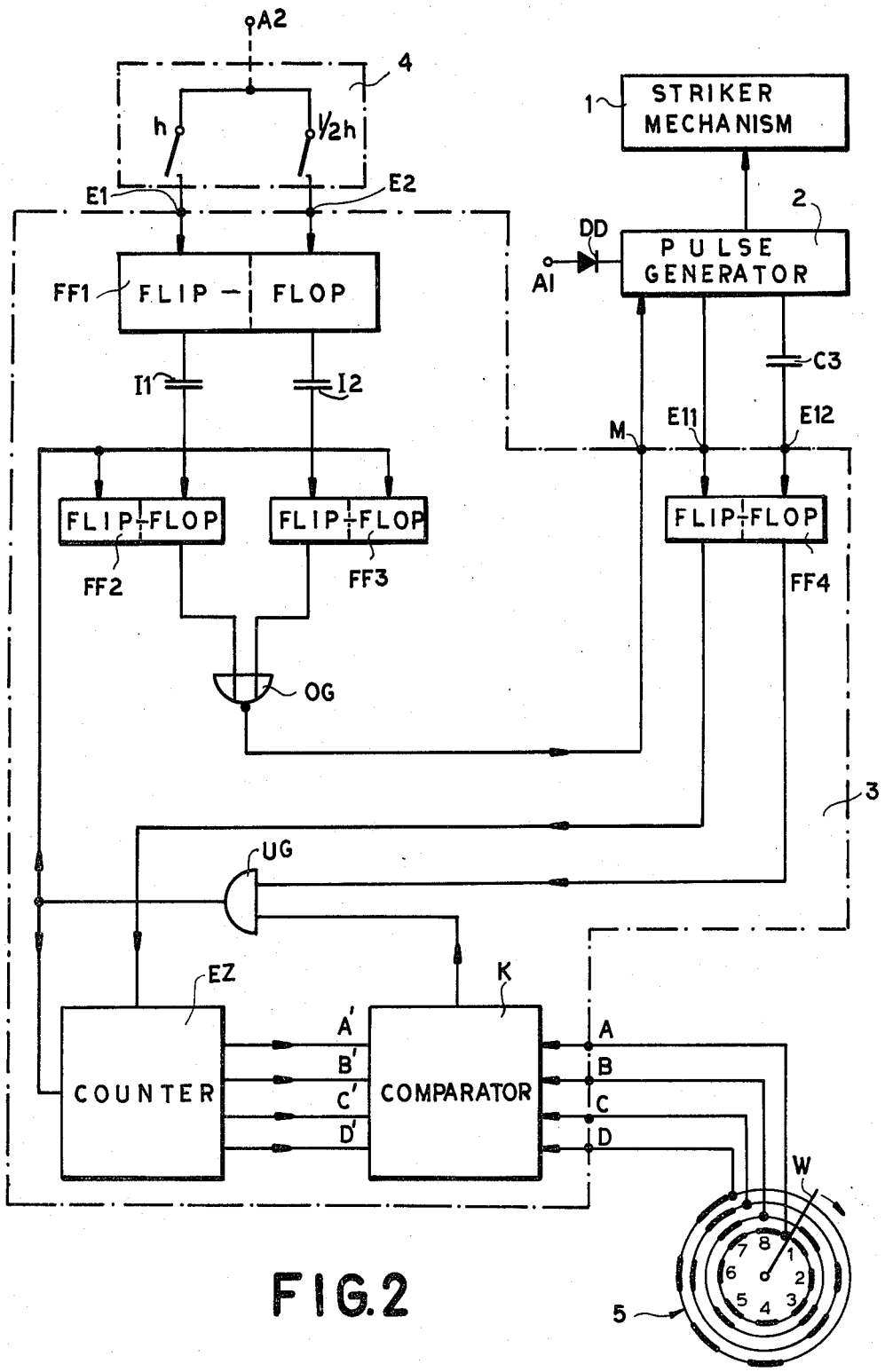
FIG. 2 shows details of a control circuit included in the diagram of FIG. 1.

As shown in FIG. 2, control circuit 3 comprises several flip-flops FF1, FF2, FF3 and FF4 as well as a binary pulse counter EZ and a comparator K, the latter being connected on the one hand to the output leads A-D of timer 5 and on the other hand to corresponding stage outputs A'-D' of counter EZ. Flip-flop FF1 has setting and resetting inputs respectively tied to terminals E1 and E2, a set output connected via a capacitor I1 (acting as a differentiator or pulse sharpener) to a setting input of flip-flop FF2, and a reset output connected via a similar capacitor I2 to a setting input of flip-flop FF3. The set outputs of flip-flops FF2 and FF3 are connected via a NOR gate OG to terminal M emitting the aforedescribed unblocking signal to pulse generator 2 when either of these flip-flops is set. Flip-flop FF4 has setting and resetting inputs respectively tied to terminals E11 and E12, a set output connected to a stepping input of counter EZ, and a reset output connected to an input of an AND gate UG whose other input is tied to an output of comparator K. The output of AND gate UG is connected to resetting inputs of flip-flops FF2, FF3 and of counter EZ.

The innermost contact bank of timer 5, connected to lead A, comprises eight contacts engaged by wiper W for a limited time in positions 45° apart. The other three banks have contacts which energize the leads B, C and D in respective wiper positions according to the binary representations of numbers 0 (position 8) and 1–7. Identical signal patterns appear on the stage outputs B′, C′ and D′ of counter EZ when the latter has counted a corresponding number of stepping pulses produced by flip-flop FF4; lead A′ may be permanently energized.

FIG. 3 shows a first closure of switch contacts ½h occurring at 1230 hours, thus at the end of the first half hour of the watch beginning at noon. That closure, as shown, happens to coincide with zero voltage on terminal A1 and is therefore not immediately effective since the collector lead Ko3 of transistor T3 (FIG. 1) is grounded at this time by the inverted square wave of terminal A2. At the beginning of the next half-cycle, positive voltage on that collector lead results in a switchover of flip-flop FF1 which sets the flip-flop FF2, thereby cutting off the NOR gate OG so that terminal M goes to zero as likewise shown in FIG. 3. Another half-cycle later, when the potential on terminal A1 goes to zero, multivibrator 2 emits a single pulse P, its collector lead Ko1 (FIG. 1) energizing the input terminal E11 of control circuit 3 while a negative pulse appearing on collector lead Ko2 is differentiated by capacitor C3 to produce an ineffectual negative spike on terminal E12. As soon as the generated pulse P terminates, a positive spike appearing at terminal E12 resets the flip-flop FF4; with wiper W in its No. 1 position, leads A and B are energized as are leads A′ and B′ since counter EZ has taken a single step. AND gate UG, therefore, conducts and resets the counter EZ as well as the flip-flops FF2 and FF3. This ends the enabling signal (zero voltage) at terminal M so that no further pulses can be generated by multivibrator 2.

Thirty minutes later, i.e. at 1300 hours, contacts h close at an instant which happens to coincide with a positive half-cycle of the wave on terminal A1. Thus, flip-flop FF1 is immediately switched, setting flip-flop FF2 and generating the enabling signal at terminal M. At the beginning of the next half-cycle, the coincidence of zero voltage on terminals A1 and M unblocks the multivibrator 2 which thereupon generates two consecutive pulses P during that half-cycle before being blocked by positive voltage on terminal A1. Since counter EZ has been stepped twice by as many settings and resettings of flip-flop FF4, comparator K now detects agreement between the signal patterns on its two sets of input leads and, via coincidence gate UG, restores the control circuit to normal.

At 1330 hours, contacts ½ h are again closed during a negative (i.e. zero-voltage) half cycle of the square wave on terminal A1. At the end of that half-cycle, as described above, flip-flop FF1 is switched over, setting flip-flop FF3 and removing positive potential from terminal M, thus resulting in the generation of two consecutive pulses P by multivibrator 2 in the immediately following half-cycle. Since comparator K does not detect an identity of signal patterns at this point, the reblocking of the multivibrator by the positive half-cycle of the square wave transmitted via diode DD is only temporary so that one further pulse is generated on the next-following negative half-cycle. At that instant, comparator K cuts off further pulse generation as soon as the positive spike on terminal E11, resetting the flip-flop FF4, confirms that the last pulse has been fully developed.

The use of two parallel interrupter contacts and three flip-flops FF1–FF3 ensures that pulse generator 2 will go into action only if contacts h and ½ h are alternatively closed. If this precaution is not required, a single pair of interrupter contacts closing every 30 minutes to set one flip-flop resettable by the output of gate UG will be sufficient; NOR gate OG may then be replaced by an inverter in the set output of that flip-flop or may be omitted if terminal M is connected to the reset output thereof.

Terminals A1 and M may be considered as connected to the blocking input (base) of multivibrator transistor T1 by the equivalent of a logical coincidence circuit or AND gate. The de-energization of these two terminals in successive half-cycles of a square wave avoids faulty triggering of the pulse generator while ensuring that translator T1 begins to conduct as soon as the logical AND condition is fulfilled.

The control circuit 3 can be easily realized with the aid of commercially available integrated-circuit modules. Pulse generator 2, even if constructed from discrete circuit components, is also inexpensive to manufacture.

We claim:

1. An electronic clock emitting time signals corresponding to the strokes of ships' bells, comprising:
   - a clockwork including a generator of a square wave with two interleaved first and second half-cycles of different voltage levels;
   - normally blocked pulse-producing means with a recurrence period equal to less than a half-cycle but not less than a quarter-cycle of said square wave;
   - a striker mechanism connected to an output of said pulse-producing means for sounding a stroke in response to each pulse emitted thereby;
   - normally open switch means briefly closed by said clockwork every thirty minutes for activating a switching circuit into emission of an unblocking signal to said pulse-producing means, said generator having an enabling circuit connected to said pulse-producing means for making said unblocking signal effective only during said first half-cycles whereby not more than two consecutive pulses can be emitted to said striker mechanism during any cycle of said square wave; and
   - control means coupled with said clockwork and connected to said pulse-producing means for deactivating said switching circuit after the emission of a number of pulses rising from one through eight in successive half-hour intervals of a four-hour operating period.

2. An electronic clock as defined in claim 1 wherein said pulse-producing means comprises an astable multivibrator with complementary first and second transistors connected in cascade, said second transistor having a collector lead constituting said output and forming part of a feedback connection to a base of said first transistor, said feedback connection including a capacitor in series with a resistor.

3. An electronic clock as defined in claim 2 wherein said switching circuit is connected to said base via a further resistor, said enabling circuit comprising a diode inserted between said generator and said base.

4. An electronic clock as defined in claim 1 wherein said generator is connected to said switch means for activating said switching circuit only during one of said second half-cycles.

5. An electronic clock as defined in claim 4 wherein said switch means comprises a first contact pair closed by said clockwork on the full hour and a second contact pair in parallel with said first contact pair closed by said clockwork on the half hour, said switching circuit including a first flip-flop with setting and resetting inputs respectively connected to said first and second contact pairs, a second flip-flop with a setting input connected to a set output of said first flip-flop, and a third flip-flop with a setting input connected to a reset output of said first flip-flop, said second and third flip-flops having outputs connected through a logic gate to said pulse-producing means for transmitting said unblocking signal thereto in response to a switchover of said first flip-flop, said second and third flip-flops having resetting inputs connected to said control means.

6. An electronic clock as defined in claim 5 wherein said control means comprises a fourth flip-flop respectively settable and resettable by said pulse-producing means at the beginning and at the end of a pulse emitted thereby, counting means with a stepping input connected to a set output of said fourth flip-flop, timing means coupled with said clockwork for emitting numerical signals representing the number of strokes to be sounded on each full and half hour of said operating period, and comparison means with input connections to said counting means and to said timing means for resetting said second and third flip-flops and said counting means upon the count of the latter equaling the value of said numerical signals.

7. An electronic clock as defined in claim 6, further comprising a coincidence gate with inputs connected to said comparison means and to a reset output of said fourth flip-flop for resetting said counting means and said second and third flip-flops only upon termination of a pulse emitted by said pulse-producing means.

8. An electronic clock as defined in claim 5 or 6, further comprising a pair of capacitors respectively inserted between the setting inputs of said second and third flip-flops and the set and reset outputs of said first flip-flop.

9. An electronic clock as defined in claim 1, 2 or 4 wherein said half-cycle has a duration of one second, said recurrence period being substantially three-quarters of a second, said pulses having a width of less than one-tenth of a second.

10. An electronic clock as defined in claim 1, 2 or 4 wherein said striker mechanism comprises electromagnetic coil means and a swingable magnetic armature controlled by said coil means.

* * * * *